US006871428B2

(12) United States Patent
Gelin

(10) Patent No.: US 6,871,428 B2
(45) Date of Patent: Mar. 29, 2005

(54) CALENDAR

(76) Inventor: David Howard Gelin, 416 Lakeshore Dr., NE., Atlanta, GA (US) 30307

( * ) Notice: Subject to any disclaimer, the term of this patent is extended or adjusted under 35 U.S.C. 154(b) by 28 days.

(21) Appl. No.: 10/444,235

(22) Filed: May 27, 2003

(65) Prior Publication Data

US 2003/0226296 A1 Dec. 11, 2003

Related U.S. Application Data

(60) Provisional application No. 60/386,588, filed on Jun. 5, 2002.

(51) Int. Cl.[7] ..... G09D 3/00

(52) U.S. Cl. ..... 40/119; 40/121; 281/38; 281/15.1; 446/147

(58) Field of Search ..... 40/119, 121, 124.19, 40/124.06, 124.191, 107; 434/236, 237, 317; 446/147; 281/3.1, 38, 22, 15.1; 283/2, 3, 4

(56) References Cited

U.S. PATENT DOCUMENTS 1,028,921 A * 6/1912 Wagner ..... 283/63.1
2,489,240 A * 11/1949 Meyer ..... 446/147
2,995,835 A * 8/1961 Friedman ..... 434/84
4,167,241 A * 9/1979 Zumbrunn ..... 229/92.8
5,031,935 A * 7/1991 D'Andrea ..... 281/15.1
5,337,949 A * 8/1994 Seeley ..... 229/92.8
5,787,617 A 8/1998 Testa

FOREIGN PATENT DOCUMENTS

JP 06135179 A * 5/1994 ..... B42D/1/00
JP 07285277 A * 10/1995 ..... B42D/1/00

* cited by examiner

*Primary Examiner*—Cassandra Davis
(74) *Attorney, Agent, or Firm*—Rodgers & Rodgers

(57) ABSTRACT

A calendar comprising front and rear covers with multiple pages disposed therebetween and being saddle stitched together. A portrait mounting area formed on the inside of the front cover with aligned perforated punch outs formed in each of the pages such that a photograph mounted in the portrait mounting area is viewable through the apertures formed by removal of the perforated punch outs.

4 Claims, 1 Drawing Sheet

CALENDAR

The benefits under 35 U.S.C. 119 are claimed of provisional application 60/386,588, filed Jun. 5, 2002.

BACKGROUND OF THE INVENTION

Many calendars currently available appeal to the personal likes and interests of consumers and are typically used to organize the user's time by providing the means to record important dates and appointments. Also, various photograph album calendars are known in which die-cut apertures are formed to allow various images to project through the apertures.

SUMMARY OF THE INVENTION

A calendar comprising front and back cover with multiple pages disposed therebetween, a photograph secured to the inside of the front cover, and aligned perforated punch outs formed in the pages.

DETAILED DESCRIPTION OF THE INVENTION

Figure 1:
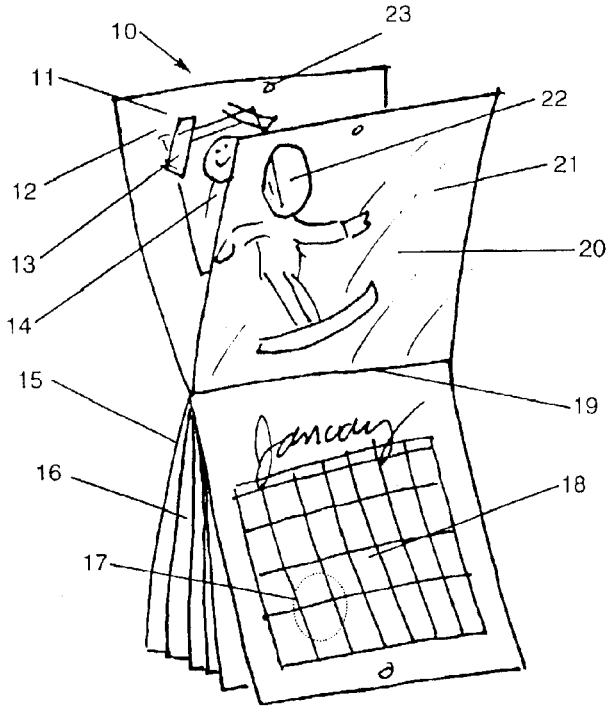
FIGS. 1 and 2 are perspective views showing the calendar according to this invention.
Figure 2:
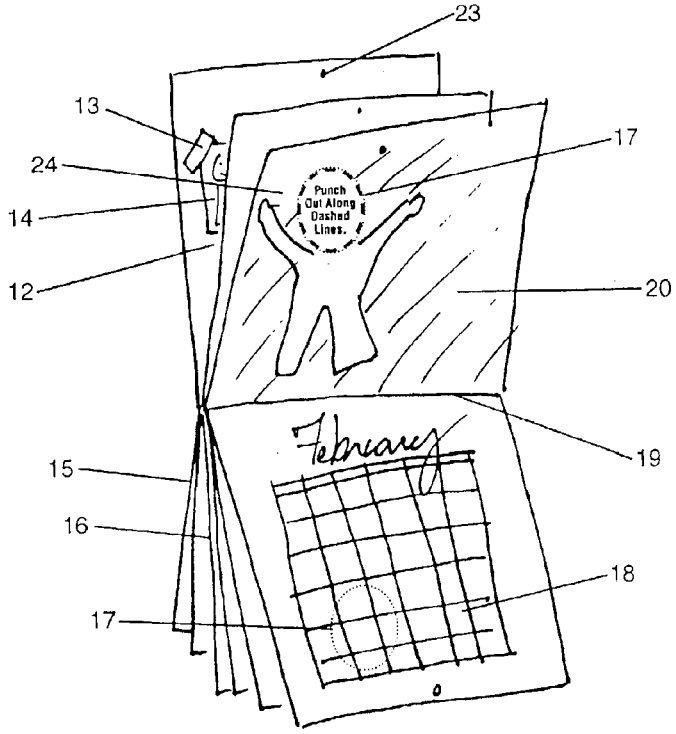

In the drawing, the numeral 10 generally designates the calendar according to this invention and which includes front cover 11 on the inside of which a portrait mounting area is provided and is designated by the numeral 12. In practice, adhesive tape 13 is utilized to secure photograph 14 to the inside front cover 11 on mounting area 12. In the drawing, photograph 14 is of a child, but photograph 14 could be of any other suitable subject matter such as adults, pets and the like.

To complete the basis elements of calendar 10, back cover 15 is provided with monthly pages 16 disposed between front cover 11 and back cover 15. According to this invention, oval perforation 17 is formed in each monthly page 16 and any other pages between inside front cover 11 and back cover 15. Each oval monthly perforation 17 is in registry the remaining perforated ovals. As is well known, calendar grid 18 is formed on each page 16 with all the pages secured together by any known means such as saddle stitching 19. Other possible means would be spiral perfect, wire-o, or GBC binding. In accordance with individual preferences, graphic scene 20 is printed on each monthly page 16.

According to one feature of this invention and in actual practice, second page leaf 21 is lifted and, generally simultaneously the portion of second page leaf 21 within perforations 17 is removed or punched out thereby forming aperture 22. Second page leaf 21 is then secured in place by means of mounting hole 23 in cooperation with any suitable means such as a hook, nail, push pin etc. Photograph 14 is then viewed through aperture 22 and typically integrated with appropriate graphics on graphic scene 20. At the end of each month, such as January, that page is lifted upwardly and the process repeated whereby a successive aperture is punched out of the succeeding page 24.

Therefore, by this invention, a calendar is provided wherein a single photograph is viewed through apertures in conjunction with a series of successive monthly pages and the aperture is only formed in a monthly page after that month has passed.

What is claimed is:

1. A calendar comprising a front cover, a back cover, multiple monthly pages disposed therebetween and being secured together, a portrait mounting area formed on an inside surface of said front cover, at least one perforated punch out formed in each of said pages, each of said pages having a front side and a back side, calendar indicia substantially cover the entire front side of each page, secondary information included within said punch out on said back sides of each page, said punch out being within the boundaries of the calendar indicia and said punch outs being incrementally removable from successive pages.

2. A calendar according to claim 1 wherein said perforated punch out is oval in configuration.

3. A calendar according to claim 1 wherein one of said perforated punch outs is formed in each of said pages.

4. A calendar according to claim 3 wherein said perforated punch outs are in registry when said pages are disposed in flat face contacting relation.

* * * * *